United States Patent [19]

Jacobson, Jr. et al.

[11] 4,448,352

[45] May 15, 1984

[54] MOLTEN ASPHALT SPRAY MECHANISM

[75] Inventors: Carl C. Jacobson, Jr., Tempe; Mark C. Manning, Chandler, both of Ariz.

[73] Assignee: Crafco, Inc., Chandler, Ariz.

[21] Appl. No.: 358,251

[22] Filed: Mar. 15, 1982

[51] Int. Cl.[3] ..... B05B 9/00

[52] U.S. Cl. ..... 239/125; 239/127; 239/170

[58] Field of Search ..... 239/124, 125, 127, 170, 239/286, 287, 551

[56] References Cited

U.S. PATENT DOCUMENTS

| | | | |
|---|---|---|---|
| 2,046,373 | 7/1936 | Etnyre | 239/551 |
| 2,330,568 | 9/1943 | Erickson | 239/551 |
| 3,043,518 | 7/1962 | Cartwright | 239/124 |
| 3,806,037 | 4/1974 | Loewenkamp | 239/124 |
| 3,838,817 | 10/1974 | Hill | 239/551 |

FOREIGN PATENT DOCUMENTS 927986 6/1963 United Kingdom .

*Primary Examiner*—John J. Love
*Assistant Examiner*—Jon M. Rastello
*Attorney, Agent, or Firm*—Herbert E. Haynes, Jr.

[57] ABSTRACT

A manually manipulatable spray mechanism for connection to a supply apparatus having a source of molten asphalt under pressure for applying a sprayed coating of molten asphalt on selected areas of a paved surface. The spray mechanism is configured so that its asphalt spray pattern may be adjusted to suit the job being accomplished, and, to provide for recirculatingly returning the molten asphalt to the supply apparatus when the spray mechanism is in the inoperative or stand by state.

9 Claims, 6 Drawing Figures

MOLTEN ASPHALT SPRAY MECHANISM

BACKGROUND OF THE INVENTION

1. Field of the Invention

This invention relates to liquid spreading devices and more particularly to a manually manipulatable mechanism for spraying a molten asphalt seal coating on selected areas of paved surfaces.

2. Description of the Prior Art

In the art of highway maintenance, it is a common practice to periodically renew the surface of the pavement by applying what is referred to as a chip seal coat on the existing paved surface. After the repair of damaged areas, such as the filling of cracks and chuck holes, a seal coating of molten asphalt is sprayed on the entire paved surface and a coating of crushed rocks, referred to in the industry as chips, is spread on the asphalt while it is still hot. The surface is then rolled with a special roller vehicle which embed the chips in the asphalt seal coating.

The equipment used in this type of highway maintenance is very large and expensive to operate. For example, the spray application of the molten asphalt seal coat is normally accomplished by using a large truck which is provided with heaters, agitators, asphalt pumps and various other devices which condition the molten asphalt and supply it under pressure from a molten asphalt supply tank to a spreader bar assembly which is carried transversely at the rear of the truck. The spreader bar usually includes a fixed central portion whose length is established by the laws which govern the maximum width of vehicles that are operated on highways. To overcome this width limitation, foldable extension spreader bars are mounted on the opposite ends of the central portion and in this way, a substantial portion of a highway is coated with each pass of the truck.

Since the entire surface of a highway, or other paved surface, is being renewed by the above described maintenance procedure, the large size of the various pieces of equipment needed to accomplish this task, such as the hereinbefore described asphalt spray truck, is needed, and the operating expenses of such equipment are justified.

However, when spot road repair work is needed, such as filling chuck holes, repairing damaged shoulders, and the like, the above mentioned equipment is much to large and expensive to use. Spot repair is, therefore, normally accomplished in a different manner. For example, a chuck hole, after being cleaned out, is filled with a hot asphalt-aggregate mix, leveled by hand and then rolled with a hand operated roller. Since no equipment for applying a molten asphalt seal coat and a chip coat is available, or suitable for such spot repair work, the chip seal coating is simply omitted. In the absence of a chip seal coating, the repaired areas are subject to relatively rapid deterioration due to traffic and environmental damage.

To the best of our knowledge, no equipment has been devised or suggested which is suitable for use in applying a seal coating of molten asphalt in relatively small areas where spot repair work is being accomplished on paved surfaces. Therefore, a need exists for a manually manipulatable mechanism for spreading a molten asphalt seal coating on selected areas of a paved surface.

SUMMARY OF THE INVENTION

In accordance with the present invention, a new and useful manually manipulatable mechanism is disclosed for spraying molten asphalt on selected areas of a paved surface.

The spray mechanism is an application device and as such is designed to work in conjunction with a suitable molten asphalt supply apparatus which is configured to contain a supply of molten asphalt, maintain the asphalt in its molten state and supply it under pressure to the spray mechanism. Apparatus suitable for this purpose are well known in the art, with an example of such an apparatus being fully disclosed in U.S. Pat. No. 4,159,877, issued on July 3, 1979.

When in use, the spray mechanism of the present invention is coupled to the suitable molten asphalt supply apparatus by a supply hose and a return hose. When the spray mechanism is in an operator selected inoperative state, as is needed from time to time, such as, for example, to move the spray mechanism from one application area to another, the molten asphalt is received under pressure from the supply apparatus and is moved through the spray mechanism and recirculatingly returned to the supply apparatus. This recirculation capability allows the supply apparatus to maintain the asphalt in its molten state which, in the absence of this capability could cool and solidify in the spray mechanism during prolonged inoperative periods thereof. When the spray mechanism is switched by the operator to its operative state, the received molten asphalt is prevented from returning to the supply apparatus and is sprayingly applied on the paved surface.

The spray mechanism includes a wheeled carriage which supportingly carries a conduit assembly having a flow switching valve therein, with the conduit assembly supportingly carrying a spray bar, so that it transversely spans the intended movement path of the mechanism. The conduit assembly is provided with a pair of coupling means to which the previously mentioned supply hose and return hose are connected for coupling the spray mechanism to the molten asphalt supply apparatus.

The spray bar is an elongated dual channel enclosure having a plurality of spray nozzles arranged in spaced increments along its length. The spray nozzles are interconnected by a gang linkage for simultaneous opening and closing thereof, and the gang linkage is connected to a control lever so that the operator of the spray mechanism can manually accomplish the opening and closing of the spray nozzles as needed.

When the spray mechanism is in its inoperative, or stand by state, the spray nozzles of the spray bar will, of course, be closed, and the flow switching valve is positioned so that the received molten asphalt will pass through part of the conduit assembly into and through the spray bar, through another part of the conduit assembly which directs it through the return hose back to the molten asphalt supply apparatus.

When the spray mechanism is switched to its operative state, by virtue of the operator manually moving the control lever, the spray nozzles of the spray bar will open and the flow switching valve is repositioned so that the received molten asphalt will be directed to the spray bar and that portion of the conduit assembly which is in communication with the return hose is closed.

The flow switching valve is coupled to the control lever by which the operator controls the position of the spray nozzles. Thus, when the spray nozzles are closed to place the spray mechanism in the inoperative state, the flow switching valve will simultaneously and automatically be positioned to recirculatingly direct the flow of molten asphalt through the spray mechanism back to the molten asphalt supply apparatus. Likewise, when the spray mechanism is switched by the operator to its operative state, the spray nozzles will open and the flow switching valve will automatically and simultaneously be repositioned to close the asphalt return portion of the conduit assembly.

The conduit assembly and the flow switching valve, in conjunction with the spray bar, are configured so that when the spray mechanism is in the inoperative state, the molten asphalt will flow through the spray bar in one direction. However, when the spray mechanism is switched to its operative state, the flow of molten asphalt into the spray bar is in two counter flowing directions which insures an even flow of asphalt to all of the spray nozzles.

The length of the spray bar and the number of spray nozzles are such that the spray pattern is ideal for most uses in spot application work on paved surfaces. However, in some instances, this spray pattern may be larger than is needed. For this reason, each of the spray nozzles are demountably connected to the gang linkage. Thus, by simply disconnecting the desired number of spray nozzles from the ganged linkage, the spray pattern can be adjustably reduced in size as needed.

Accordingly, it is an object of the present invention to provide a new and useful manually manipulatable molten asphalt spray mechanism for applying a seal coating of asphalt on selectable areas of a paved surface.

Another object of the present invention is to provide a spray mechanism of the above described character, having an operator selected inoperative stand by state wherein molten asphalt is recirculatingly directed in a flow path wherein it passes through the mechanism to prevent cooling and solidification of the molten asphalt therein.

Another object of the present invention is to provide a spray mechanism of the above described character having an operator selected operative state wherein molten asphalt is directed in a supply flow path wherein it is supplied in counter flowing directions to insure an even flow distribution.

Another object of the present invention is to provide a new and useful spray mechanism of the above described character, wherein the flow of molten asphalt is simultaneously and automatically switched between its recirculating flow path and its supply flow path when the spray mechanism is switched between its inoperative and operative states.

Still another object of the present invention is to provide a spray mechanism of the above described character wherein the size of the spray pattern is adjustable.

The foregoing and other objects of the present invention as well as the invention itself, will be more fully understood from the following description when read in conjunction with the accompanying drawings.

DESCRIPTION OF THE PREFERRED EMBODIMENT

Figure 1:
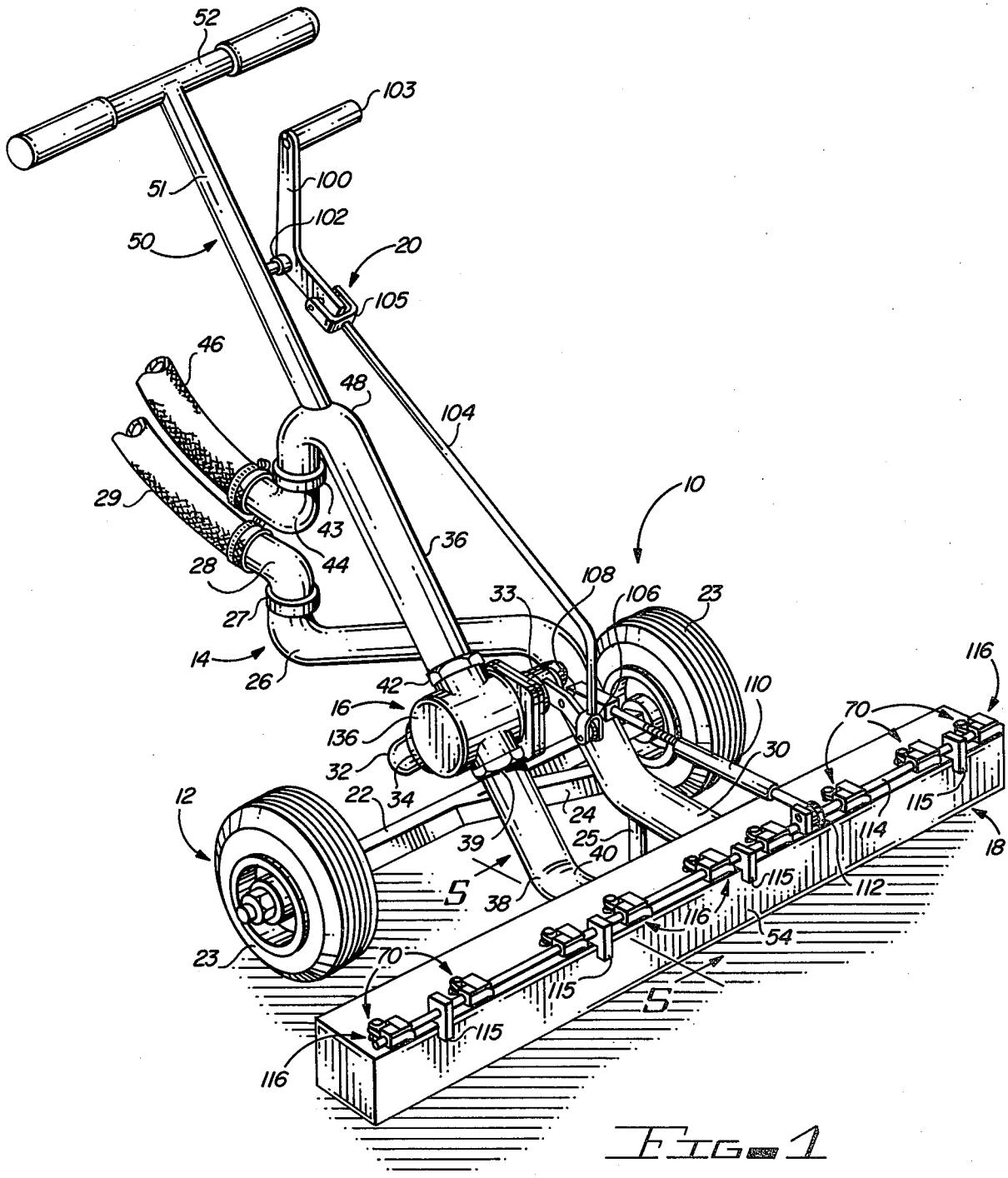
FIG. 1 is a perspective view of the manually manipulatable molten asphalt spray mechanism of the present invention showing the various features thereof.
Figure 2:
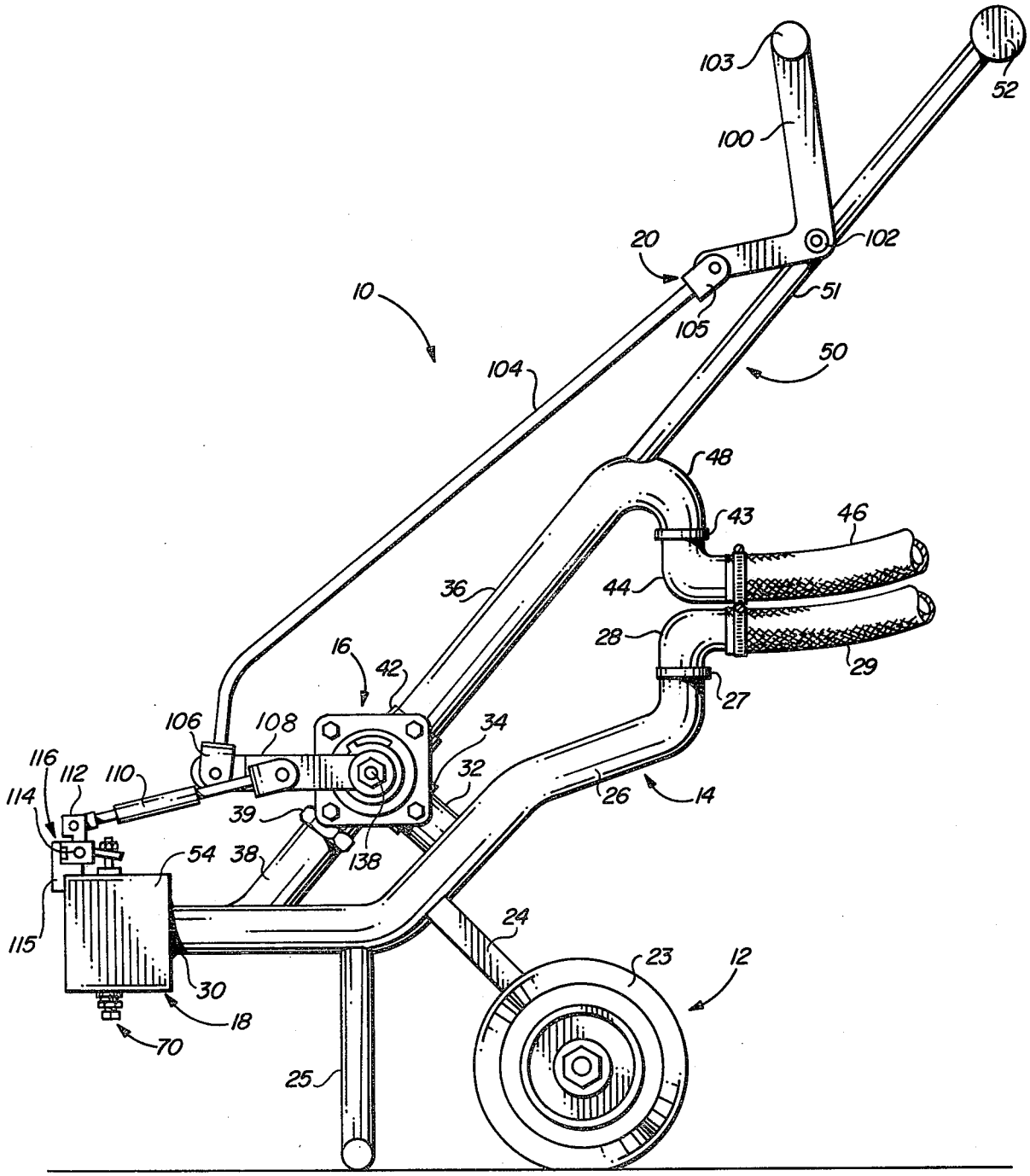
FIG. 2 is an enlarged side elevational view of the mechanism.

Referring more particularly to the drawings, FIGS. 1 and 2 show the manually manipulatable molten asphalt spray mechanism of the present invention which is indicated generally by the reference numeral 10. As will hereinafter be described in detail, the spray mechanism 10 includes the major components of a wheeled carriage 12, a conduit assembly 14, a flow switching valve 16, a spray bar 18 and a control mechanism 20.

The wheeled carriage 12 has a single axle 22 with a pair of wheels 23 journalled for rotation at the opposite ends thereof. The carriage 12 also includes a bar 24 integrally attached to the axle 22 intermediate its opposite ends, and the bar extends from the axle and is fixedly attached to the conduit assembly 14. Thus, the wheeled carriage 12 supportingly carries all the other components of the spray mechanism 10 as will become apparent as this description progresses. A stand 25 is mounted on the conduit assembly so as to depend therefrom. This stand is employed for parking of the spray mechanism 10 and to prevent the spray bar 18 from being moved to close to the surface which is being sprayed by the spray mechanism.

The conduit assembly 14 includes a molten asphalt input conduit 26 having a swivel joint fitting 27 on one end thereof which couples a 90° elbow 28 thereto. A flexible molten asphalt input hose 29 is shown as being suitably mounted on the elbow 28 for supplying molten asphalt under pressure to the spray mechanism 10 from a suitable supply apparatus (not shown). As hereinbefore described, any of several well known supply mechamism can be employed for this purpose, with a specific example being fully disclosed in the hereinbefore referenced U.S. Patent. The opposite end 30 of the input conduit 26 is fixedly attached to the spray bar 18, such as by welding. The conduit assembly 14 also includes a crossover conduit 32 having one of its ends fixedly attached to the input conduit 26 as at 33 and having its other end connected to the molten asphalt input port 34 of the flow switching valve 16. In addition to the input conduit 26 and the crossover conduit 32, the conduit assembly 14 also includes a return conduit 36 and a reversible flow conduit 38. The reversible flow conduit 38 is coupled to the molten asphalt supply port 39 of the flow switching valve 16 and extends therefrom to the spray bar 18 and is fixedly connected thereto as at 40, such as by welding. The return conduit 36 is connected to the molten asphalt return port 42 of the flow switching valve 16 and its opposite end has a swivel joint fitting 43 and a 90° elbow 44 mounted thereon. The elbow 44 is shown as having a flexible molten asphalt return hose 46 connected thereto which is for returning molten asphalt to the supply apparatus (not shown). The asphalt flow paths through the above described conduit assembly 14 will hereinafter be described in detail.

As shown, the asphalt return conduit 36 is bent as at 48 and a handle assembly 50 is fixedly attached to that conduit at the bend 48 so as to extend therefrom. The handle assembly 50 includes an extending bar 51 with a transverse crossbar 52 on its extending end to provide handle grips by which an operator may push and manually manipulate the spray mechanism 10 in the conventional and well known manner.

The asphalt input conduit 26 and the reversible flow conduit 38 are fixedly attached to the spray bar 18 as hereinbefore described, and those conduits supportingly carry the spray bar so that it is parallel to the axle 22 of the wheeled carriage and thus, is disposed transverse of the intended movement path of the spray mechanism.

The spray bar 18 includes an elongated box beam housing 54 which is closed at its opposite ends and is provided with an internal chamber having a longitudinally extending partition wall 55 and a divider partition wall 56 therein. As seen best in FIGS. 3 and 4, the longitudinally extending partition wall 55 is vertically disposed and positioned between the front and back walls 57 and 58 of the spray bar housing 54 with its opposite ends being spaced from the closed end walls of the housing 54 to provide openings 59 and 60. The divider partition wall 56 is also vertically disposed and it extends normally from the longitudinally extending partition wall 55 to the back wall 58 of the spray bar housing 54.

The partition walls 55 and 56 divide the internal chamber of the spray bar housing 54 into a first molten asphalt flow passage 62 which is in communication with one end of a second flow passage 64 by means of the opening 59 with the other end of the flow passage 64 being in communication with a third flow passage 66 by means of the opening 60.

Figure 3:
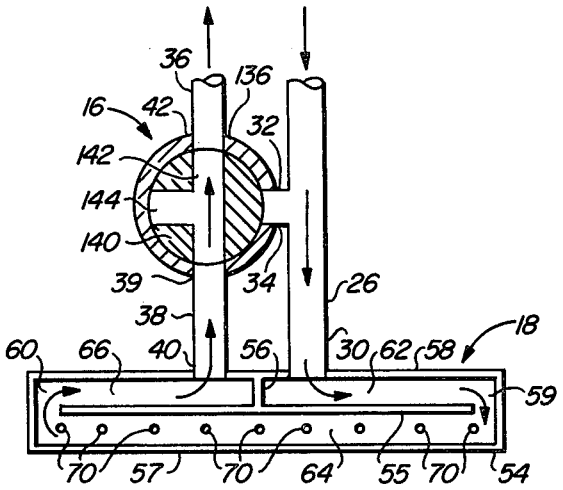
FIG. 3 is a diagrammatic illustration showing the recirculating flow path of the molten asphalt when the mechanism of the present invention is in the inoperative, stand by state.
Figure 4:
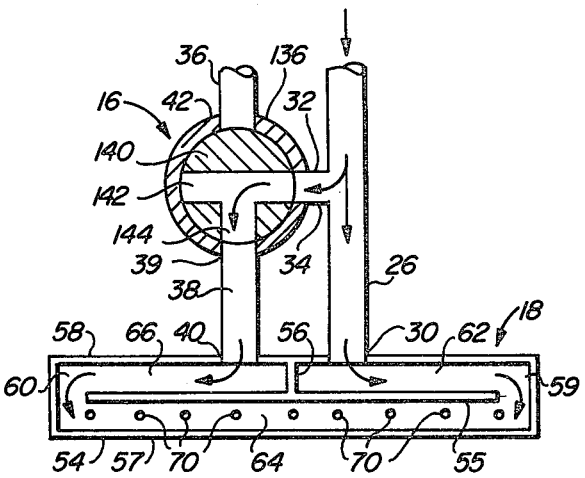
FIG. 4 is a diagrammatic illustration similar to FIG. 3 but showing the supply flow path of the molten asphalt when the mechanism is in its operative state.

The end 30 of the molten asphalt input conduit 26 opens into the first flow passage 62 and the end 40 of the reversible flow conduit 38 opens into the third flow passage 66 as seen best in FIGS. 3 and 4.

The spray bar 18 is provided with a plurality of liquid spray nozzles 70 which are spacedly arranged along the length of the spray bar housing 54. The spray nozzles 70 are identical structures and the following description of a typical one thereof will be understood to apply to all of the nozzles.

Figure 5:
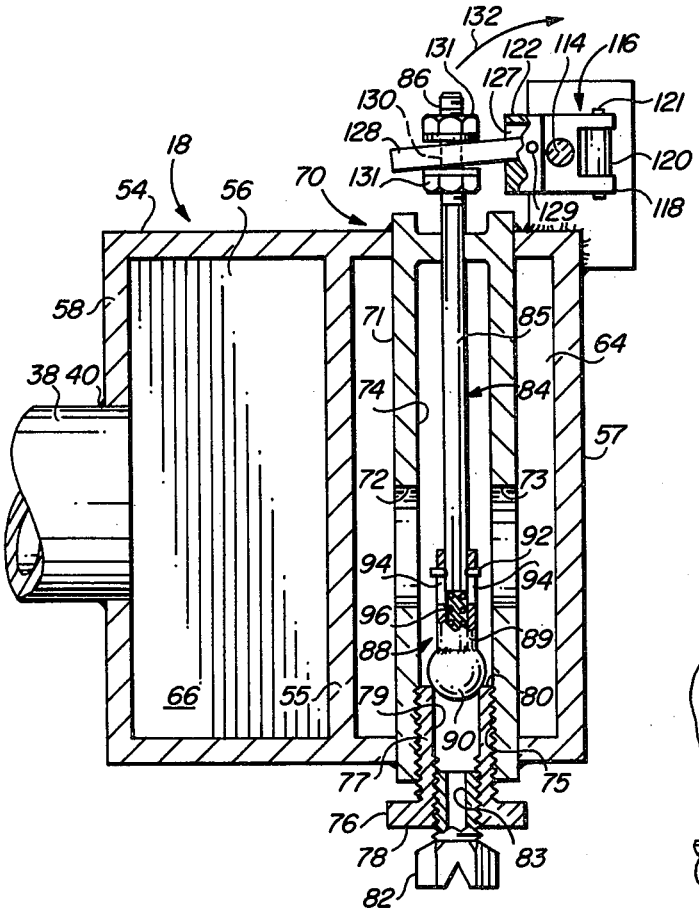
FIG. 5 is an enlarged fragmentary sectional view taken along the line 5—5 of FIG. 1 to show the internal configuration of the spray bar of the spray mechanism and a typical one of the plural spray nozzles.

As seen best in FIG. 5, the typical asphalt spray nozzle 70 includes a hollow elongated cylindrical valve body 71 which is mounted in the spray bar housing 54 so as to pass vertically through the second flow passage 64 thereof and is sealingly secured in the top and bottom walls of the housing, such as by welding. The valve body 71 has at least a pair of relatively large openings 72 and 73 formed in its sides so that molten asphalt moving through the second flow passage 64 of the housing 54 is free to flow into the bore 74 of the valve body. The depending end of the valve body 71 extends below the bottom wall of the housing 54 and is internally threaded as at 75 to sealingly receive a plug 76 therein. The plug 76 is formed with an externally threaded shank portion 77 and a head portion 78 in the form of a nut. An axial bore 79 is drilled or otherwise formed through the plug 76, with the upwardly disposed end of the shank 77, which circumscribes the axial bore 79, serving as a valve seat 80, and with the downwardly disposed end of the axial bore being internally threaded to sealingly receive an orifice plug 82 which has an axial bore 83 formed therethrough. A slide valve 84 is mounted in the body 71 and is axially movable in the bore 74 thereof. The slide valve 84 includes an elongated valve stem 85 having its upper end threaded as at 86, with the upper end extending axially from the valve body 71. A valve head assembly 88 is mounted on the other end of the valve stem 85 for movement with the stem into and out of seated engagement with the valve seat 80. The valve head assembly 88 includes a tubular sleeve 89 which is concentrically and slidably mounted on the depending end of the valve stem 85 with a ball 90, or other suitably configured head, welded or otherwise affixed to the extending end of the tubular sleeve 89. The valve head assembly 88 is captively retained on the depending end of the valve stem 85, and its axial slidable movement is limited by a pin 92 which is transversely carried in the end of the stem 85 so that each of its oppositely extending ends are positioned in a different one of a pair of elongated slots 94 provided in diametrically opposed sides of the tubular sleeve 89. A compression spring 96 is disposed within the tubular sleeve 89 so as to bear against the end of the valve stem 85 and to bear against the ball 90. In this manner, the valve head assembly 88 is yieldably biased to its axially extended position.

The control mechanism 20, as seen best in FIGS. 1 and 2, includes an L-shaped lever 100 which is pivotably carried on a trunnion 102 which extends laterally from the extending bar 51 of the handle assembly 50. The lever 100 is provided with a hand grip member 103 on one end thereof which is adjacent the crossbar 52 of the handle assembly 50 so as to be conveniently within reach of the operator of the spray mechanism 10. The other end of the L-shaped lever is connected to one end of a tie-rod 104 by means of a clevis 105 provided on the tie-rod. The opposite end of the tie-rod 104 is similarly provided with a clevis 106 which is attached to the laterally offset extending end of an operating lever 108 of the flow switching valve 16 for reasons which will hereinafter be described in detail.

The operating lever 108 of the flow switching valve 16 has one end of an adjustable connecting rod 110 attached thereto, with the opposite end of the connecting rod 110 being connected to a clevis 112 which is fixedly carried on a rock shaft 114. The rock shaft 114 is suitably journalled for rotation in bearing blocks 115 which are fixedly carried atop the spray bar housing 54. The rock shaft 114 is disposed to extend substantially along the length of the spray bar 18 in upwardly spaced relationship with respect to the top surface thereof, so that it is proximate each of the plurality of liquid spray nozzles 70.

Each of the plurality of liquid spray nozzles 70 is demountably connected to the rock shaft 114 by a connection block assembly 116. Each of the block assemblies 116 is identical, thus, the following description of a typical one of the those connection block assemblies 116 will be understood to also apply to the other block assemblies.

Figure 6:
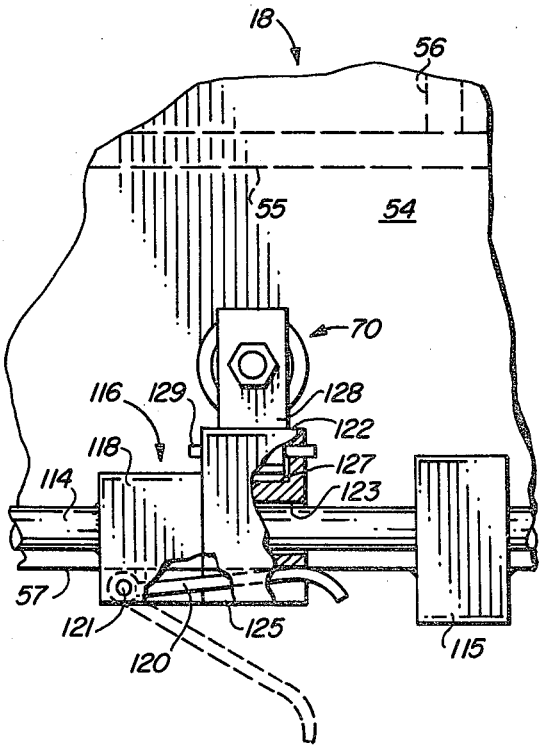
FIG. 6 is an enlarged fragmentary plan view of the illustration of FIG. 5 showing the demountable connection of a typical spray nozzle to the gang linkage which interconnects the plural spray nozzles.

As seen best in FIGS. 5 and 6, a typical one of the connection block assemblies 116 includes a first block 118 which is fixedly carried on the rock shaft 114, such as by welding, for rotation therewith. The first, or fixed, block 118 has a latching lever 120 attached thereto by the pivot pin 121. Immediately adjacent the fixed block 118 is a second block 122 which demountably couples the liquid spray nozzles 70 to the fixed block 118 and thus, to the rock shaft 114. The second, or coupling block 122, has a bore 123 formed therethrough and the rock shaft 114 passes loosely through this bore 123. In this manner, the coupling block 122 is held in position by the rock shaft but is not in and of itself tied to the rock shaft for rotation therewith. The coupling block 122 has a slot 125 formed in one end thereof which is alignable with the latching lever 120 of the fixed block 118. As seen in FIG. 6, manual movement of the latching lever 120 to its latching position, as shown in solid lines, will place the lever within the slot 125 of the coupling block 122. When in this latched position, the first and second blocks 118 and 122 will be demountably connected to each other and will thus rotatably move as a single entity upon rocking movement of the rock shaft 114. When the latching lever 120 is manually moved to the unlatched position thereof, as shown in dashed lines in FIG. 6, the connection between the blocks 118 and 122 is broken and the coupling block 122 will no longer respond to rocking movements of the rock shaft. The other end of the coupling block 122 has a cutout 127 formed therein and one end of a plate 128 is disposed in the cutout and is connected to the coupling block by means of a pivot pin 129. The extending end of the plate 128 has a hole 130 formed therethrough with the threaded end 86 of the valve stem 85 passing through the hole. Suitable nuts 131 are carried on the uppermost end of the valve stem 85 so that rocking movement of the rock shaft 114 in the direction of arrow 132 will be transmitted through the coupling block assembly 116, when the blocks 118 and 122 are latchingly interconnected in the manner described above, and the plate 128 will lift the slide valve 84 off of its seat 80 and thus move the liquid spray nozzle 70 from its closed to its open position. Similarly, rocking movement of the rock shaft in the direction opposite to the arrow 132 will move the slide valve 84 into seated engagement with the valve seat 80, thus closing the spray nozzle.

With all of the plurality of spray nozzles 70 demountably coupled to the rock shaft 114 in the hereinbefore described manner, it will be appreciated that the spray bar 18 will emit molten asphalt in a spray pattern having a given width dimension. In many instances however, this width of spray pattern will be in excess of that needed to properly spot repair a paved surface. Therefore, by decoupling one or more of the spray nozzles 70 from the rock shaft 114, the width of the spray pattern can be reduced as needed.

As hereinbefore mentioned, the tie-rod 104 of the control mechanism 20 is connected to the operating lever 108 of the flow switching valve 16. Therefore, when the operator of the spray mechanism 10 moves the L-shaped lever 100 to change the mechanism between an operating mode, i. e., opens the spray nozzles 70, and an inoperative or stand by mode, i. e., spray nozzles 70 closed, the flow switching valve 16 will automatically and simultaneously be repositioned.

When the spray mechanism 10 is in its inoperative state, the flow switching valve 16, as seen in FIG. 3, is positioned so that the molten asphalt received under pressure from the suitable supply apparatus (not shown) passes through the input conduit 26 into the first flow passage 62 of the spray bar housing 54. The molten asphalt then exits the flow passage 62 through the opening 59 into one end of the second flow passage 64, passes the full length of the second passage 64 and enters the third flow passage 66 via the opening 60. The reversible flow conduit 38 directs the molten asphalt from the third flow passage 66 of the spray bar housing 54 to the flow switching valve 16 which directs it to the return conduit 36 which returns the molten asphalt to the supply apparatus (not shown).

Thus, when the spray mechanism 10 is in its inoperative, or stand by state, it will be seen that the flow of molten asphalt is in a recirculating flow mode which prevents the asphalt from cooling and solidifying in the spray mechanism 10.

When the operator switches the spray mechanism 10 to the operating state thereof, the spray nozzles 70 will be opened and the flow switching valve 16 will be automatically and simultaneously repositioned as hereinbefore described and the resulting molten asphalt flow path is shown in FIG. 4. The molten asphalt under pressure is received in the input conduit 26 and passes into the first flow passage 62 of the spray bar housing 54, and it also flows through the crossover conduit 32, through the repositioned flow switching valve 16, through the reversible flow conduit 38 into the third flow passage 66 of the spray bar housing 54. In this manner, molten asphalt under pressure is in the molten asphalt supply flow mode, in that it is received simultaneously in the first and third flow passages 62 and 66 of the spray bar housing 54 and will flow through the openings 59 and 60 into both ends of the second flow passage 64. By supplying molten asphalt to the opposite ends of the second flow passage 64, an evenly distributed supply of the asphalt will be delivered to all of the plurality of spray nozzles 70 of the spray bar 18.

The flow switching valve 16, which may be any of several well known devices, is shown as including a body 136 having the previously mentioned ports 34, 39 and 42 by which the flow switching valve is mounted and connected into the conduit assembly 14 of the spray mechanism. As seen best in FIG. 2, the operating lever 108 of the flow switching valve 16 is suitably connected to a valve positioning shaft 138 to rotate that shaft when the lever 108 is repositioned as hereinbefore described. The shaft 138 extends from the valve body 136 and is suitably journalled for rotation therein in the well known manner for rotatably repositioning a rotary valve 140 as shown schematically in FIGS. 3 and 4. The rotary valve 140 is provided with flow passage 142 which passes diametrically therethrough and a branch flow passage 144 which transversely intersects the diametrically extending passage. In this manner, when the flow switching valve 16 is positioned so that the flow of molten asphalt is in the recirculating mode, the rotary valve 140 is positioned so that the diametrically disposed passage 142 interconnects the reversible and return conduits 38 and 36 respectively, and the branch passage 144 is closed. When the flow switching valve 16 is repositioned to achieve the molten asphalt supply flow mode, the rotary valve 140 is positioned so that one end of the diametrically disposed passage 142 is blocked with the other end, in conjunction with the branch passage 144, interconnecting the crossover and reversible flow conduits 32 and 38 respectively.

While the principles of the invention have now been made clear in an illustrated embodiment, there will be immediately obvious to those skilled in the art, many modifications of structure, arrangements, proportions, the elements, materials, and components used in the practice of the invention, and otherwise, which are particularly adapted for specific environments and operation requirements without departing from those principles.

Although the spray mechanism of the present invention is herein described as being primarily for use in applying spray coatings of molten asphalt, it will be understood that this specific use is not intended as a limitation of the present invention. Virtually any liquid can be applied by the mechanism with a specific example, which also relates to the highway repair art, being emulsified asphalt which, as is known, is not a molten liquid but is asphalt containing an asphalt solvent, such as kerosene.

The appended claims are therefore intended to cover and embrace any such modifications within the limits only of the true spirit and scope of the invention.

What we claim is:

1. A manually manipulatable spray mechanism for use with a spray apparatus having a source of molten asphalt under pressure, said spray mechanism for spraying a coating of molten asphalt on selected areas of a paved surface and comprising:

(a) a wheeled carriage for manual manipulation;

(b) a conduit assembly carried on said carriage and having input and return conduits on one end for coupling to the supply apparatus;

(c) a spray bar carried on the other end of said conduit assembly and defining an internal chamber and having first and second ports in communication with said conduit assembly;

(d) at least a pair of nozzles extending from the internal chamber of said spray bar and movable between open and closed states;

(e) a single flow switching valve in said conduit assembly and having a first position in which the molten asphalt receivable in said conduit assembly is supplied to the first port of said spray bar circulated through the internal chamber thereof and is received from the second port of said spray bar and returned by said conduit assembly to the supply apparatus and a second position in which the molten asphalt receivable from the supply apparatus is simultaneously supplied to the first and second ports of said spray bar; and (f) manually operable control linkage coupled to operatively interconnect said pair of spray nozzles and said flow swithing valve for simultaneous movement between a first operational mode wherein said flow switching valve is in the first position thereof and said pair of spray nozzles are closed and a second operational mode wherein said flow switching valve is in the second position thereof and said pair of spray nozzles are open.

2. A spray mechanism as claimed in claim 1, wherein said spray bar is an elongated structure mounted on said conduit assembly so as to transversely span the intended movement path of said spray mechanism.

3. A spray mechanism as claimed in claim 1 wherein said pair of spray nozzles of said spray bar are interconnected by a gang linkage means with said control means being connected to said gang linkage means for simultaneously moving said pair of spray nozzles between their open and closed states upon manual operation of said control means.

4. A spray mechanism as claimed in claim 1 wherein each of said pair of spray nozzles of said spray bar are demountably connected to said gang linkage means for adjustably changing the spray pattern of said spray bar.

5. A spray mechanism as claimed in claim 1 wherein said flow switching valve has an operating lever which is coupled to said control means so that when said pair of spray nozzles are moved to their open states, said flow switching valve will be automatically and simultaneously switched so as to direct the molten asphalt to said spray bar and when said pair of spray nozzles are moved to their closed states, said flow switching valve will be automatically and simultaneously switched to recirculatingly return the molten asphalt to the supply apparatus.

6. A spray mechanism as claimed in claim 1 and further comprising:

(a) said flow switching valve having an inlet port, a supply port and a return port;

(b) said conduit assembly including,

I. said input conduit having one end for connection to said supply apparatus and having an opposite end connected to the first port of said spray bar, II. a crossover conduit having one end connected to said input conduit intermediate its opposite ends with its other end connected to said input port of said flow switching valve, III. a reversible flow conduit having one end connected to said supply port of said flow switching valve and its other end connected to the second port of said spray bar, IV. said return conduit having one of its ends connected to the return port of said flow switching valve with its other end being for connection to the supply apparatus; and (c) the first position of said flow switching valve placing said inlet port and said supply port thereof in communication with each other with said return port being closed and the second position thereof closing said input port and placing said supply port of said return port in communication with each other.

7. A spray mechanism as claimed in claim 1 wherein said spray bar comprises:

(a) an elongated box beam housing defining an internal chamber;

(b) partition means within said box beam housing to divide the internal chamber thereof into a first asphalt flow passage one end of which is in liquid communication with said input conduit, a second asphalt flow passage one end of which is in liquid communication with the other end of said first asphalt flow passage and a third asphalt flow passage one end of which is in liquid communication with the other end of the second asphalt flow passage with the other end of the third asphalt flow passage being in liquid communication with said reversible flow conduit; and (c) said pair of spray nozzles being located in the second molten asphalt flow passage provided by said partition means in the internal chamber of said box beam housing.

8. A spray bar mechanism as claimed in claim 1 wherein said wheeled carriage comprises:

(a) a single axle;

(b) a pair of wheels rotatably journalled on the opposite ends of said axle; and (c) a bar extending between said axle and said conduit assembly for supportingly mounting said conduit assembly thereon.

9. A spray mechanism as claimed in claim 1 and further comprising a handle assembly fixedly mounted on said conduit assembly and extending therefrom.

* * * * *